US006426322B2

(12) United States Patent
Alexander

(10) Patent No.: US 6,426,322 B2
(45) Date of Patent: Jul. 30, 2002

(54) FUNCTIONAL FLUID

(75) Inventor: Albert Gordon Alexander, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/778,252

(22) Filed: Feb. 7, 2001

Related U.S. Application Data

(60) Provisional application No. 60/181,138, filed on Feb. 8, 2000.

(51) Int. Cl.[7] ..... C10M 101/02

(52) U.S. Cl. ..... 508/110; 208/18; 208/19; 585/13; 252/71

(58) Field of Search ..... 508/110

(56) References Cited

U.S. PATENT DOCUMENTS

| | | | | | |
|---|---|---|---|---|---|
| 3,915,871 | A | | 10/1975 | Bryer et al. | 252/33.6 |
| 4,717,489 | A | | 1/1988 | Schieman | 252/32.7 E |
| 5,064,546 | A | | 11/1991 | Dasai | 252/32.5 |
| 5,167,847 | A | | 12/1992 | Olavesen et al. | 252/50 |
| 5,321,172 | A | | 6/1994 | Alexander et al. | 585/2 |
| 5,344,582 | A | | 9/1994 | Umemoto et al. | 252/9 |
| 5,688,748 | A | * | 11/1997 | Tomizawa | 508/363 |
| 5,840,662 | A | * | 11/1998 | Nibert et al. | 508/291 |
| 5,858,935 | A | * | 1/1999 | Watts et al. | 508/591 |
| 6,110,879 | A | | 8/2000 | Kramer et al. | 508/469 |
| 6,187,725 | B1 | | 2/2001 | Kramer et al. | 508/469 |

* cited by examiner

*Primary Examiner*—Ellen M. McAvoy
(74) *Attorney, Agent, or Firm*—Joseph J. Allocca

(57) ABSTRACT

A functional fluid base oil is described comprising a mixture of (1) one or more naphthenic base stocks, and (2) one or more conventional solvent neutral base stocks and (3) one or more hydrocracked base stocks. The functional fluid base oil can be additized by the addition of one or more performance additives. The fluid is especially usefull as a power steering fluid base oil.

2 Claims, No Drawings

FUNCTIONAL FLUID

This application claims benefit of Provisional Application No. 60/181,138 filed Feb. 8, 2000.

BACKGROUND OF THE INVENTION

Functional fluids comprise a broad range of lubricants that are used in automotive and industrial hydraulic systems, automotive transmissions, power steering systems, shock absorber fluids, and the like. These fluids transmit and control power in mechanical systems, and thus must have carefully controlled viscometric characteristics. In addition, these fluids may sometimes be formulated to provide multigrade performance so as to ensure year round operation in variable climates.

Power Steering Fluids (PSF) are one of the most common functional fluids, and an integral part of all power steering systems. Power steering is used in about 80% to 90% of all vehicles in North America and Japan and their use is becoming more commonplace in other parts of the world. These systems are considered "safety sensitive" and the major OEMs have stringent specifications to control all aspects of the components that go into their manufacture, including the fractional fluid.

A power steering system comprises a pump, gears, output drives and hydraulic system. The PSF acts as a hydraulic fluid to transfer power in the system and thus assist the driver to control the vehicle. Loss of control could lead to an accident and thus the fluid must have the right viscometrics at ambient start-up temperatures, while maintaining sufficient viscosity at higher operating temperatures. PSF must also be very oxidation stable since it is subjected to high temperatures and is expected to remain in service for up to 100,000 miles in some cases. In addition, and perhaps amongst the most important requirements for a power steering fluid is compatibility with seals and hoses, which can be measured in various ASTM tests, for example, D 471.

In the past power steering fluids generally used blends of naphthenic and solvent neutral base stocks, and their use is still common in many applications. However, over the past few years, with the increasing performance demands being made on power steering fluids, the use of "next generation" hydrocracked base stocks could offer oxidation advantages. However, such molecular compositional changes would not be expected to be compatible with the seals and hoses in power steering systems.

DESCRIPTION OF THE INVENTION

The present invention is directed to a functional fluid base oil which comprises:

(i) at least one naphthenic base stock having a kinematic viscosity of about 1.5 to about 3.5 $mm^2$/sec at 100° C., preferably about 1.5 to about 2.5 $mm^2$/sec at 100° C., a viscosity index of about 90 or less, preferably about 80 or less, a pour point of about −42° C. maximum, an aniline point of about 90° C. or less and a saturates content of about 90 mass % or less; and (ii) at least one conventional solvent neutral base stock having a kinematic viscosity of about 2.5 to about 6.5 $mm^2$/sec at 100° C., preferably about 3.0 to about 5.5 $mm^2$/sec at 100° C., a viscosity index of about 90 to about 105, preferably about 90 to about 100, a pour point of about −12° C. maximum, preferably about −15° C. maximum, an aniline point of about 95 to about 105° C., a saturates content of about 75 to about 90 mass %, preferably about 80 to about 90 mass %; and (iii) at least one hydrocracked base stock having a kinematic viscosity of about 3.5 to about 6.5 $mm^2$/sec at 100° C., preferably about 3.8 to about 5 $mm^2$/sec at 100° C., more preferably about 4.2 to about 4.8 $mm^2$/sec at 100° C., a viscosity index of about 100 to about 120, preferably about 105 to about 120, more preferably about 110 to about 120, a pour point of about −12° C. maximum, preferably about −15° C., more preferably about −18° C., an aniline point of about 100° C. to about 120° C., preferably about 105° C. to about 115° C., a saturates content of about 92 to about 99 mass %, preferably about 93 to about 99 mass %, more preferably about 94 to about 96 mass %;

wherein the naphthenic base stock (i) is present in an amount of about 15 vol % to about 45 vol %, preferably about 15 vol % to about 35 vol %;

wherein the solvent neutral base stock (ii) is present in an amount of about 15 vol % to about 45 vol %, preferably about 25 vol % to about 45 vol %;

wherein the hydrocracked base stock (iii) is present in an amount of about 15 vol % to about 45 vol %, preferably about 25 vol % to about 45 vol %;

(iv) optionally from about 0 vol % to about 30 vol %, preferably about 0 vol % to about 20 vol % of a second hydrocracked base stock comprising one or more hydrocracked bases stocks having a kinematic viscosity of about 1.5 to about 3.5 $mm^2$/sec at 100° C., a viscosity index of about 90 or higher, a pour point of about −24° C. maximum, an aniline point of about 95 to about 110° C., a saturates content of about 90 to about 99 mass %;

said mixture of base stocks having a base stock blend kinematic viscosity of about 3 to about 5 $mm^2$/sec at 100° C., preferably about 3.5 $mm^2$/sec to about 4.5 $mm^2$/sec at 100° C., a viscosity index of about 90 to about 115, preferably about 95 to about 110, a pour point of about −24° C. maximum, preferably about −30° C. maximum; and (v) optionally at least one performance additive.

When the functional fluid is additized the resulting additized functional fluid has a kinematic viscosity of about 6.5 to about 9.5 $mm^2$/sec at 100° C., preferably about 7.5 to about 8.5 $mm^2$/sec at 100° C., a viscosity index of about 150 to about 200, a pour point of about −42° C. maximum, and a Brookfield viscosity of about 25,000 cP or less at −40° C., preferably about 20,000 cP or less at −40° C., and meets seal compatibility requirements.

In the formulation the naphthenic base stock(s) and solvent neutral base stock(s) are those oils well known in the industry and produced by conventional techniques similarly well known in the petroleum industry.

The hydrocracked base stocks may be prepared by use of any of the hydrocracking process procedures currently used in the art, as well as any processes yet to be developed. It is believed the performance and function of the hydrocracked base stocks in the present invention are independent of the particular procedural techniques employed in the production of the base stocks. Typically hydrocracked base stocks are made starting with distillate from the atmosphere/vacuum pipestills and/or coker distillate, optionally subjecting such distillate to an aromatics removal step using an aromatics selective solvent such as phenol, furfural, NMP, etc. The distillate is then subjected to hydroconversion in at least one hydroconversion zone, more typically two zones whereas the distillate is exposed to a catalyst in the presence of hydrogen at high temperature and pressure to effect the saturation of aromatics, open rings and reduce sulfur and nitrogen content.

If the previously recited, optional aromatics removal step was not produced, the stream from the hydroconversion stage(s) can now be subject to an aromatics removal step such as solvent extraction employ a selective solvent such as phenol, furfural, NMP, etc. This stream can then be subjected to wax removal employing solvent dewaxing or catalytic dewaxing or isomerization. The stream, either before or after such dewaxing can also be subjected to hydrofinishing to further reduce the sulfur and nitrogen content.

Examples of suitable hydrocracking processes can be found in "All Hydroprocessing Route for High Viscosity Index Lubes" Zakarian et al Energy Progress, Vol. 7, No. 1, pp. 59–64; "Hydrotreated Lube Oil Base Stocks" Cashmore et al, SAE Paper 821235; "Lube Facility Makes High Quality Lube Oil from Low Quality Feed" Farrell et al, Oil and Gas Journal, May 19, 1986, Technology, pp. 47–51, U.S. Pat. No. 5,976,353.

Additives useful in preparing fully formulated functional fluid(s), especially power steering fluids include:

VI improvers generally of the polymethacrylate type, but also styrene esters, olefin copolymers, which may be non dispersant or dispersant, or mixtures thereof, antiwear additives can be alkyl, aryl or alkyl/aryl phosphate esters, thiophosphates, sulphurized olefins, zinc dialkyldithiophosphates, or mixtures thereof, antioxidants such as phenolic, amine, or combinations thereof, antirust additives, copper corrosion or other metal deactivators, friction modifiers such as glycerides, fatty acids, fatty amines, etc., pour point depressants, antifoams such as silicone polymers, acrylate polymers.

Typically, a power steering additive package will be employed in an amount in the range of about 5 vol % to about 20 vol % as received, preferably about 6 vol % to about 16 vol % as received, wherein the maximum amount of diluent oil in the total additive package is between 0 to about 40 vol %.

What is claimed is:

1. A functional fluid base oil comprising:

(i) at least one naphthenic base stock having a kinematic viscosity of about 1.5 to about 3.5 $mm^2$/sec at 100° C., a viscosity index of about 90 or less, a pour point of about −42° C. maximum, an aniline point of about 90° C. or less, a saturates content of about 90 mass % or less;

(ii) at least one conventional solvent neutral base stock, having a kinematic viscosity of about 2.5 to about 6.5 $mm^2$/sec at 100° C., a viscosity index of about 90 to about 105, a pour point of about −12° C. maximum, an aniline point of about 95° C. to about 105° C., a saturates content of about 75 to about 90 mass %;

(iii) at least one hydrocracked base stock having a kinematic viscosity of about 3.5 to about 6.5 $mm^2$/sec at 100° C., a viscosity index of about 100 to about 120, a pour point of about −2° C. maximum, an aniline point of about 100° C. to about 120° C., a saturates content of about 92 to about 99 mass %; wherein the naphthenic base stock is present in the amount of about 15 vol % to about 45 vol % the solvent neutral base stock is present in the amount of about 15 vol % to about 45 vol % the hydrocracked base stock is present in the amount of about 15 vol % to about 45 vol %;

(iv) optionally from about 0 vol % to about 30 vol % of a second hydrocracked base stock comprising one or more hydrocracked bases stocks having a kinematic viscosity of about 1.5 to about 3.5 $mm^2$/sec at 100° C., a viscosity index of about 90 or higher, a pour point of about −24° C. maximum, an aniline point of about 95 to about 110° C., a saturates content of about 90 to about 99 mass % said mixture of base stocks having a kinematic viscosity of about 3 to about 5 $mm^2$/sec at 100° C., a viscosity index of about 90 to about 115, a pour point of about −24° C. maximum.

2. The functional fluid base oil of claim 1 further containing (v) an additive package, the additized functional fluid having, a kinematic viscosity of about 6.5 to about 9.5 $mm^2$/sec at 100° C., a viscosity index of about 150 to about 200, a pour point of about <−42° C. maximum, and a Brookfield of about <25,000 cP or less at −40° C.

* * * * *